United States Patent [19]

Oberpriller

[11] 4,116,017

[45] Sep. 26, 1978

[54] METHOD OF AND APPARATUS FOR THE COOLING OF ARTICLES WITH A CIRCULATED COOLING GAS

[75] Inventor: Jakob Oberpriller, Baierbrunn, Germany

[73] Assignee: Linde AG., Höllriegelskreuth, Germany

[21] Appl. No.: 747,404

[22] Filed: Dec. 3, 1976

[30] Foreign Application Priority Data

Dec. 6, 1975 [DE] Fed. Rep. of Germany ..... 2554906

[51] Int. Cl.[2] ..... F25D 17/06

[52] U.S. Cl. ..... 62/62; 62/95; 62/514 R

[58] Field of Search ..... 62/62, 89, 514 R, 45, 62/380, 95

[56] References Cited

U.S. PATENT DOCUMENTS

| | | | |
|---|---|---|---|
| 2,943,459 | 7/1960 | Rind | 62/514 R |
| 3,106,070 | 10/1963 | Harper et al. | 62/514 R |
| 3,122,897 | 3/1964 | Overbye | 62/380 |
| 3,878,691 | 4/1975 | Asztalos | 62/514 R |
| 3,882,687 | 5/1975 | Asztalos et al. | 62/514 R |
| 3,960,206 | 6/1976 | Baxter et al. | 62/514 R |

*Primary Examiner*—Ronald C. Capossela
*Attorney, Agent, or Firm*—Karl F. Ross

[57] ABSTRACT

Articles such as vehicle tires, synthetic-resin scraps and other objects, which can be embrittled at low temperatures for subsequent cold-milling, are cooled with a circulated cooling gas which is itself cooled by the injection of an expandable coolant in liquid form therein. The liquid, prior to injection into the cooling-gas stream, is subjected to heat exchange therewith whereby the enthalpy of vaporization is supplied to the liquid before it is sprayed into the circulated gas.

8 Claims, 2 Drawing Figures

METHOD OF AND APPARATUS FOR THE COOLING OF ARTICLES WITH A CIRCULATED COOLING GAS

CROSS-REFERENCE TO RELATED APPLICATIONS

This application is related to my commonly assigned copending applications Ser. No. 450,454 filed Mar. 12, 1974, Ser. No. 568,736 filed 16 April 1975 (both now abandoned), and Ser. No. 648,100 filed Jan. 12, 1976.

FIELD OF THE INVENTION

The present invention relates to a method of and to an apparatus for the cooling of objects with a circulated cooling gas into which a liquid coolant is injected to lower the temperature of the circulated gas after it has been warmed by heat exchange with the articles.

BACKGROUND OF THE INVENTION

Certain articles, such as rubber vehicle tires and synthetic-resin scraps, can be embrittled by deep cooling with a circulated cooling gas so that their subsequent low-temperature milling can be effected with ease. The above-mentioned copending applications described various systems for carrying out the low-temperature embrittlement and low-temperature milling of various articles and materials using these principles. It is also known to deep-cool articles by heat exchange with a circulated cooling gas, e.g. nitrogen, as, for example, is the case with the cooling of electrical components such as magnets in superconductive or cryogenic systems.

One of the most effective ways of lowering the temperature of the closed-cycle recirculated cooling gas is the injection of a coolant, usually of the same composition as the cooling gas, in liquid form into the circulation system.

Thus, it is already known, in cold-milling processes or in the cooling of objects or materials of various kinds, to abstract heat from the articles or materials with a circulated cooling gas and, after this gas has been heated in heat exchange with the objects, to mix with it a deep-cooled liquid coolant to cool down the recirculated gas and thus contribute cold to the system corresponding to the heat abstracted and maintain a predetermined cooling-gas temperature at which it is contacted with the articles.

The liquefied cooling medium (coolant) is injected by nozzles into the circulating path of the cooling gas at higher pressure than the latter and in a boiling state. As a result of the injection of the coolant into the cooling-gas recirculation path and the pressure differential to which the injected medium is subjected at the nozzle, a portion of the injected cooling medium expands, causing a condensation thereof and the formation of droplets which are entrained with the cooling gas over relatively long distances of, for example, 4 to 6 meters, until these droplets evaporate by heat exchange and temperature equilibration within the cooling-gas stream into which they are introduced.

Depending upon the pressure differential and the temperatures of the injected coolant and the cooling-gas into which it is injected, therefore, the complete expansion and complete heat exchange of the injected medium with the cooling gas may not be complete until the mixture has traveled from the injection site to the aforementioned significant distance therefrom.

In most cases, such long equilibration stretches are not tolerable and hence existing systems have had the problem that droplets of incompletely evaporated liquid coolant contacted the objects, articles or components which were to be cooled, thereby producing local supercooling, spontaneous fragmentation or breakage of the articles, materials or objects, or irregular cooling thereof.

It has been proposed to eliminate the problem by providing ahead of the injection site, along the path of the coolant to be injected, a nozzle which regulates the supply of the liquefied coolant into the circulating path of the cooling gas. This is intended to bring about a preliminary expansion with gas formation of the coolant to be injected before it is actually introduced into the recirculated cooling gas.

A disadvantage of this system is that, instead of relatively small flow rates of the added liquid, relatively large (by volume) quantities of gas must be introduced into the recirculating cooling gas by the nozzles. As a practical matter it is found that the injection of gas into the recirculating stream is seldom uniform so that significant temperature fluctuations are produced in the cooling gas and control of the temperature thereof is difficult or impossible.

OBJECTS OF THE INVENTION

It is the principal object of the present invention to provide a method of and an apparatus for the cooling of articles with a recirculated cooling gas in which the cooling of this recirculated gas can be effected without substantial technological expenditures, using a liquid coolant which is fed in a gaseous state into the recirculated gas, but without the disadvantages enumerated above.

It is another object of my invention to provide an improved method of cooling a recirculated cooling gas which may be heated in contact with articles, objects or materials to be cooled.

Another object of the invention is to provide an apparatus that is free from the aforedescribed problems which result when a preliminary expansion of the coolant to be added must be effected before it is supplied to a recirculated cooling gas.

SUMMARY OF THE INVENTION

These objects and others which will become apparent hereinafter are attained, in accordance with the invention, in a method of and an apparatus for the cooling of objects, articles or substances by bringing them into heat-exchanging relationship with a recirculating cooling gas and cooling the latter gas to a predetermined temperature level by feeding a liquid coolant from a storage facility to an enclosure or mixing chamber traversed by the recirculating stream, the coolant being admitted into the enclosure through an expansion valve. Pursuant to an important feature of my invention, the liquefied coolant is heated on the way to the expansion valve to an extent corresponding to its vaporization enthalpy (heat of vaporization per unit quantity injected), resulting in a transformation of the coolant from the liquid state to the gaseous state at the interface between the liquid and the recirculating gas phases at the valve orifice. The cooling gas in the circulating system is at a pressure below that at which the liquid coolant is stored.

The invention is based upon the thermodynamic principle that, in a closed system in which heat is supplied at constant pressure, there is a corresponding increase in enthalpy. Thus, if a coolant is drawn from a supply tank under constant pressure and is introduced into the closed system, and sufficient heat is supplied to correspond to the vaporization enthalpy, the coolant can be transformed at its boiling point from a liquid state below the saturation line of the enthalpy/absolute temperature diagram (i-T diagram) to a substantially instantaneous vapor state corresponding to a point close to the vapor-saturation line of the i-T diagram. This corresponds to an instantaneous change of state from the liquid to the gas at the mouth of the nozzle or orifice without any tendency of the resulting expansion to condense droplets of the injected coolant.

By an expansion of the coolant to the operating pressure of the cooling gas in circulation, according to the present improvement, the vapor-saturation line of the i-T diagram can be reached or exceeded so that the coolant is transformed from the two-phase state at the outlet of the nozzle completely to the gaseous state. Naturally, in spite of the temperature reduction resulting from expansion of the injected coolant, the latter is only introduced into the cooling gas in the gaseous state.

I have found it especially advantageous to increase the enthalpy of the coolant by supplying the added heat, necessary to meet the requirements for vaporization enthalpy, from the cooling gas which is circulated along the aforementioned closed path. Since the cooling gas is warmed by abstracting heat from the objects to be cooled, this heat can be transferred to the cooling medium in a heat exchanger, thereby simultaneously resulting in a precooling of the circulated cooling gas and the delivery of the heat of vaporization to the cooling medium before its expansion. An increase in the enthalpy of the cooling medium (coolant) is thus obtained without additional energy expenditure, and only by using the energy available in the system, merely by providing a heat exchanger in an upstream portion of the mixing chamber. Best results are obtained when the coolant is liquefied nitrogen or liquefied carbon dioxide since both can be produced inexpensively and with ease. The relatively sharp rise in the vapor-saturation line in the i-T diagram of liquefied nitrogen ensures that, even with reduced pressure differences between the coolant and the cooling gas, the $N_2$ present in a state of near vapor saturation can be shifted by expansion above the vapor-saturation line and thus brought into the completely gaseous state, free from droplets or particles of liquid $N_2$.

It will be apparent that this is advantageous because it allows the cooling gas to be fed around the circulating system at a relatively low pressure and also permits the liquid nitrogen to be supplied at a relatively low tank pressure yet with a pressure difference sufficient to enable overstepping of the vapor-saturation line. The pressure of the supply tank, of course, is optimally dependent upon the pressure in the circulation path of the cooling gas and upon the heat transfer from the cooling gas to the coolant since, with a correspondingly high pressure, the vaporization enthalpy of the coolant is reduced.

The process of the present invention has been found to be effective also with liquid carbon dioxide as the cooling medium or coolant. Since, as is known, the expansion of the carbon dioxide from the liquid or gas phase at a pressure below 5.28 atmospheres results in the formation of particles of solid $C0_2$, the $C0_2$ can be used as the cooling medium with earlier processes only when the cooling gas is displaced at a pressure above 5.28 atmospheres in the circulating path. This, however, cantravenes the desire to use a simple apparatus to maintain the circulation.

As can be seen from an i-T diagram for $C0_2$, above an enthalpy level of 155.1 kcal/kg the carbon dioxide can be jumped over the vapor-saturation line upon expansion of $C0_2$ below 5.28 atomospheres without the precipitation of solid carbon dioxide.

Thus, according to another aspect of the invention, the carbon dioxide before injection into the cooling gas is subjected to heat exchange with the latter to bring coolant to an enthalpy value of at least 155.6 kcal/kg, whereby the pressure in the supply tank for the $C0_2$ can be between 7 atmospheres and 35 atmospheres. As long as expansion of the $C0_2$ takes place below a pressure of 5.28 atmospheres, only gaseous $C0_2$ is formed and there is a complete transformation from the gas-liquid state to the gas state.

According to another feature of the invention, the apparatus comprises a circulating path for the cooling gas, this path including the aforementioned mixing chamber which forms the heat exchanger as well. A pipe extends through this mixing chamber and can be provided with ribs or can supply a plate heat exchanger within the mixing chamber. The outlet of the supply pipe and hence the heat exchanger is open in the direction of flow of the cooling gases and is provided with an expansion valve to control the feed of the coolant into the cooling gases as required to maintain a predetermined temperature of these circulating gases corresponding to the quantity of cooling gas discharged from the circulation path. I prefer to expand the coolant into the cooling gas proximal to the mixing chamber and have the coolant pass through the pipe or plate heat exchanger over the larger portion of the length of the mixing chamber. The vaporization enthalpy is transferred to the coolant prior to its emergence at the expansion valve at which it is injected into the cooling gas and the transfer of heat to the coolant depends upon the effectiveness of the heat exchanger and the temperature differential thereacross.

BRIEF DESCRIPTION OF THE DRAWING

The above and other objects, feature and advantages of the present invention will become more readily apparent from the following description, reference being made to the accompanying drawing in which.

SPECIFIC DESCRIPTION AND EXAMPLE

Figure 1:
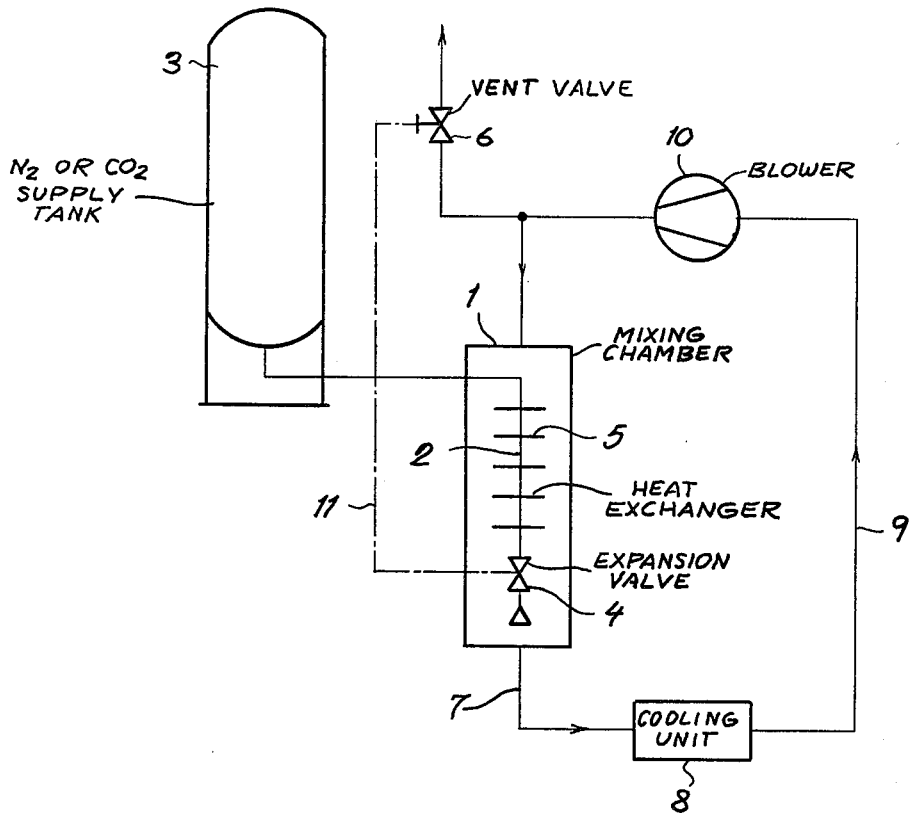
FIG. 1 is a diagram of an apparatus for the cooling of objects according to the present invention.

FIG. 1 shows a mixing chamber 1 which is connected in the circulating path of a cooling gas, usually the same gas which is supplied by the coolant injector to the circulating system. The mixing chamber 1 encloses a heat exchanger 2, in a preferred embodiment of the invention, comprising at least one ribbed or finned pipe 5. The upstream end of the pipe 5 communicates with a supply tank 3 for the liquefied coolant externally of the mixing chamber 1.

The other end of the pipe 5 opens in the direction of flow of the cooling gas into the mixing chamber and is provided with an expansion valve 4. The circulating cooling gas traversing the mixing chamber thus transfers its heat via the heat exchanger 2 to the coolant before it reaches the initially closed expansion valve 4 at this point the coolant is at a higher pressure than the cooling gas so that the enthalpy in the coolant of the closed system is raised.

When evaporation enthalpy of the coolant is attained, the valve 4 is opened to permit the coolant to expand exclusively in a gaseous state into the mixing chamber and merge with the cooling gas therein to lower its temperature.

The cold gas mixture is carried via line 7 into a chamber 8 to cool the articles, objects or material to be chilled or embrittled. The unit 8 can thus represent a cooling column of a cold-milling apparatus of the type described in the aforementioned applications or the patents referred to therein.

In the unit 8, the cooling gas is heated by the energy abstracted from the cold objects and is conducted via a line 9 and a blower 10 back into the mixing chamber 1.

Downstream of the blower 10, a gas-venting valve 6 is provided which can be operatively connected to the valve 4 as represented diagrammatically at 11 so as to ensure a functional relationship between the venting of excess gas at 6 and the admission of the coolant at 4 so that the cooling-gas quantity in the circulation path is maintained constant and only warmed gas is vented.

Figure 2:
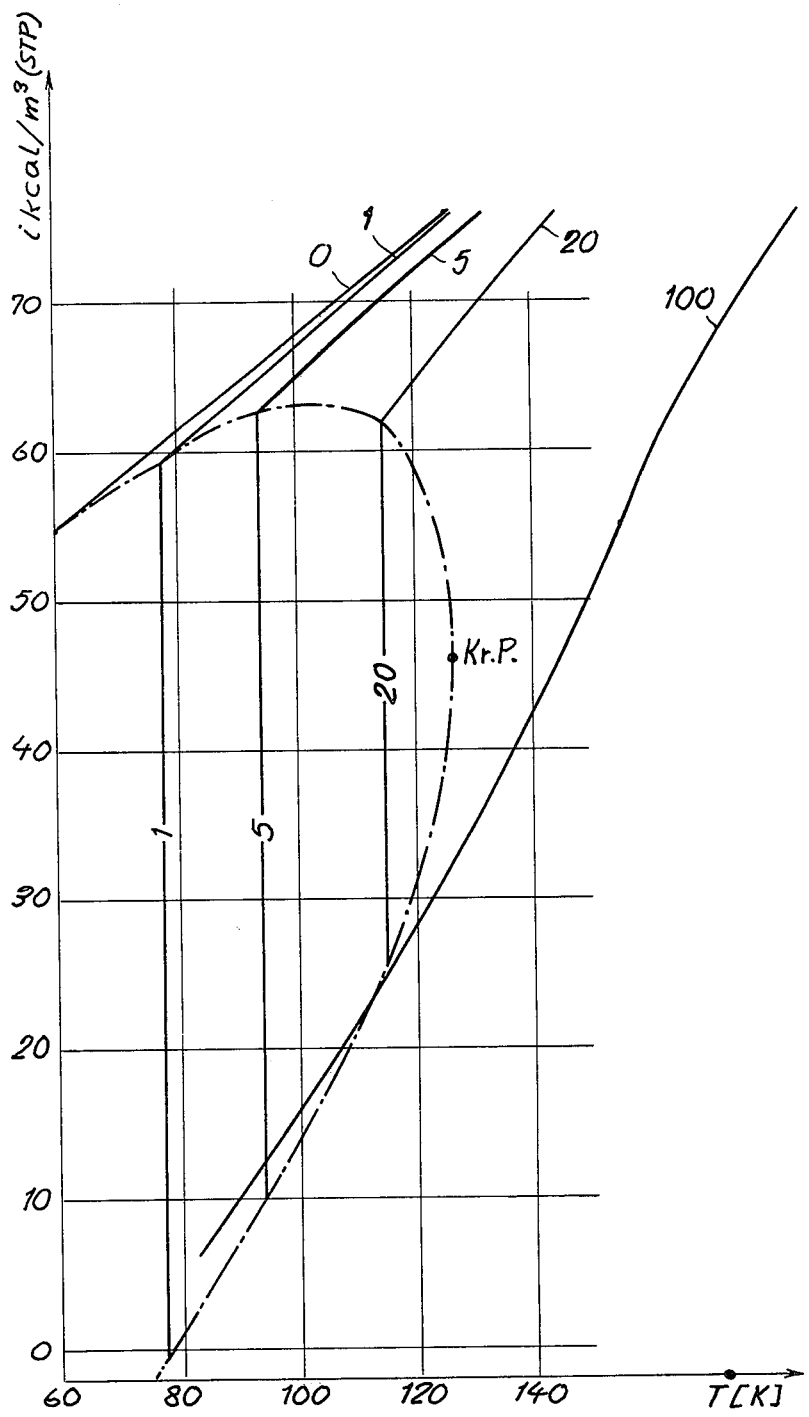
FIG. 2 is an enthalpy-temperature diagram for nitrogen to clarify the specific example given below.

FIG. 2 is an i-T diagram for 1 cubic meter $N_2$ at standard temperature and pressure (STP) in the temperature range of 60° to 140° K. and an enthalpy range of 0 to 70 kcal/m$^3$ (STP). This diagram is intended to facilitate understanding of the specific example according to which 300 m$^3$ (STP)/hour of liquid nitrogen is injected into 1200 m$^3$ (STP)/hour of circulating gas (nitrogen) at −40° C. With a tank pressure of the liquid nitrogen of 5 atmospheres and a pressure in the circulating path of the cooling gas of 1 atmosphere, the i-T diagram shows that the vaporization enthalpy of the liquid nitrogen is 52.5 kcal/m$^3$ (STP).

Thus, for the 300 m$^3$ (STP)/hour of liquid nitrogen, 15,750.0 kcal/hour of heat must be supplied to equal the required vaporization enthalpy. Since the vaporization enthalpy is drawn from the circulating cooling gas, and the specific heat of the cooling gas is 0.31 kcal/m$^3$ (STP)° C., a precooling of the cooling gas by 42.3° C. is obtained. The cooling gas is thus cooled by the heat exchange alone from −40° C. to −82° C. The expansion of the coolant to a pressure of 1 atmosphere into the circulated cooling gas results in a temperature, confirmed by the i-T diagram, of −187° C. of the coolant which is mixed with the cooling gas at −82.3° C. to yield the final cooling-gas temperature at which it contacts the objects to be cooled.

I claim:

1. A process for the deep cooling of an article which comprises the steps of:

circulating a cooling gas along a closed path through an enclosure;

contacting said article with the circulated cooling gas downstream of said enclosure at a relatively low temperature, thereby warming said cooling gas;

injecting a liquid coolant from a storage facility into said enclosure through an expansion valve to merge with the warmed cooling gas and reduce the temperature thereof upon expansion of the injected coolant, the coolant being stored at said facility under a pressure higher than that of said enclosure; and supplying heat to the coolant on its way from said facility to said expansion valve in a quantity corresponding only to the vaporization enthalpy of said coolant.

2. The process defined in claim 1 wherein said coolant is heated by passing it through an upstream portion of said enclosure in heat-exchange relationship with the warmed cooling gas, thereby precooling said cooling gas.

3. The process defined in claim 2 wherein said coolant is nitrogen.

4. The process defined in claim 2 wherein said coolant is carbon dioxide.

5. The process defined in claim 4 wherein the liquid carbon dioxide coolant at a pressure between 5 and 35 atmospheres is heated to an enthalpy value of at least 155.6 kcal per kg prior to injection into said cooling gas.

6. An apparatus for cooling an article, comprising, means forming a circulating path for a cooling gas including a unit for contacting the article therewith and a mixing chamber upstream of said unit receiving the circulating cooling gas;

a supply tank for storage of a liquid coolant under pressure;

a heat exchanger in said mixing chamber connected at an upstream end thereof to said supply tank for heating said liquid coolant in heat-exchanging relationship with the circulating cooling gas to the vaporization enthalpy of the liquid coolant; and an expansion valve within said mixing chamber connected to said heat exchanger at a downstream end thereof for expanding the liquid coolant in said mixing chamber to merge with the circulating cooling gas.

7. The apparatus defined in claim 6 wherein said heat exchanger is a finned tube.

8. The apparatus defined in claim 6, further comprising a venting valve connected to said circulating path for discharging warm cooling gas therefrom and means operatively connecting said valves to maintain the quantity of cooling gas circulated along said path substantially constant.

* * * * *